US005809741A

United States Patent [19]

Tovey

[11] Patent Number: 5,809,741

[45] Date of Patent: Sep. 22, 1998

[54] CARTON CONCAVING DEVICE

[75] Inventor: John Michael Tovey, Lane, Nebr.

[73] Assignee: Tetra Laval Holdings & Finance, SA, Pully, Switzerland

[21] Appl. No.: 844,895

[22] Filed: Apr. 22, 1997

[51] Int. Cl.[6] ..... B65B 7/28

[52] U.S. Cl. ..... 53/289; 53/487

[58] Field of Search ..... 53/289, 487, 403, 53/432, 510; 493/87, 184

[56] References Cited

U.S. PATENT DOCUMENTS

| | | | |
|---|---|---|---|
| 3,295,293 | 1/1967 | Lodding | 53/289 |
| 3,491,803 | 1/1970 | Galik | 53/289 |
| 3,590,557 | 7/1971 | Vogel | 53/289 |
| 3,945,174 | 3/1976 | Franz | 53/289 |
| 3,973,603 | 8/1976 | Franz | 53/289 |
| 4,484,977 | 11/1984 | Andersson | 493/184 |
| 4,738,077 | 4/1988 | Wakbayashi et al. | 493/184 |
| 4,860,902 | 8/1989 | Kieser | 493/184 |
| 4,869,047 | 9/1989 | Nishiguchi et al. | 53/432 |
| 4,926,613 | 5/1990 | Hansen . | |
| 4,964,561 | 10/1990 | Whelan . | |
| 5,085,035 | 2/1992 | Marano et al. . | |
| 5,201,165 | 4/1993 | Marano et al. . | |
| 5,452,563 | 9/1995 | Marano et al. . | |
| 5,538,491 | 7/1996 | Owen et al. | 493/184 |
| 5,562,227 | 10/1996 | Takezawa et al. . | |

*Primary Examiner*—Daniel Moon
*Assistant Examiner*—John Paradiso
*Attorney, Agent, or Firm*—Michael A. Catania

[57] ABSTRACT

The disclosure includes a carton concaving device capable of manipulating and maintaining the shape of a carton being sealed on a packaging machine. The device has a shaft which rotates with the movement of a conveyor chain thereby allowing for indexed movement of the device. The device has a plurality of rollers for deflecting the sidewalls of a carton about to be sealed at a top sealing station on a packaging machine. The device may be an add-on component or an integrated component of a packaging machine. The device reduces the number of bulged cartons being dispensed from a packaging machine.

3 Claims, 14 Drawing Sheets

CARTON CONCAVING DEVICE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to devices for concaving gable top cartons. Specifically, the present invention relates to a device for manipulating the shape of a gable top carton being processed on a form, fill and seal machine.

2. Description of the Related Art

Gable top cartons have been known for the better part of the twentieth century. Their characteristic simplicity and resealability have helped to sustain their popularity as cartons for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

During decades of development, manufacturers of packaging machines have devised a variety of ways to form, fill and seal gable top cartons. Presently, the most prevalent packaging machines for filling and sealing gable top cartons are adapted to receive the carton blank after is has been side sealed. The process of side sealing involves sealing opposite vertical edges of the carton blank together to form a polygonal (usually rectangular) sleeve. The sleeve is received on an indexable mandrel wheel which rotates the sleeve into respective positions where the end of the sleeve extending outwardly from the mandrel is folded and sealed to form the bottom of the carton.

After the carton bottom has been formed, it is removed from the mandrel and transported to a filling station where the carton is filled with product. Once the carton has been filled, the top of the carton is folded into the familiar gable top configuration and is heat sealed, thus completing the packaging process.

One example of a known packaging machine that operates generally in accordance with these principles is described in U.S. Pat. No. 5,518,578 to Persells, et al. Other examples of such packaging machines are described in U.S. Pat. No. 3,789,746 to Martensson, et al, U.S. Pat. No. 3,820,303 to Martensson, et al, U.S. Pat. No. 4,759,171 to Bruveris, et al, and U.S. Pat. No. 4,790,123 to Ljungstrom, et al. These patents are hereby incorporated by reference.

Once the carton has been sealed at the sealing station, any defect in the carton is irreversible. If the sides of the carton are bulging out due to the weight of the product, the carton is perceived as damaged which will render the carton and its contents unusable. Post sealing manipulation of the carton will not render the damaged carton acceptable to the dairy or the consumer. Gasses from a spoiled product increase the pressure inside of a sealed carton thereby causing the sidewalls to bulge. Thus, any bulging carton is perceived as containing a spoiled product.

BRIEF SUMMARY OF THE INVENTION

The present invention provides a solution the problem of non-spoiled bulging cartons. The present invention is able to greatly reduce the number of bulging cartons being dispensed from a packaging machine thereby increasing efficiency.

One aspect of the present invention is a device for manipulating the shape of cartons being conveyed on a form, fill and seal packaging machine. The packaging machine has a top sealer to seal the top of cartons. The top sealer is located at a station on the packaging machine above a conveyor. The device includes a frame attachment means, a shaft, a plurality of rollers and a sprocket. The frame attachment means is for connecting the device to the packaging machine at the top sealer station. The shaft is capable rotating about a shaft axis. The shaft has a first end and a second end. The shaft has a plurality of arms extending transversely therefrom. The shaft is connected to the frame attachment means on at least one of the first end and the second end. In this design, the shaft may be fixed. This design places the device on a frame which holds the rollers and rotates on bearings.

The plurality of rollers is attached to corresponding extending arms. Each of the rollers rotate about a roller axis. Each of the roller axes are parallel to the shaft axis. Each of the rollers deflect the side of a carton at the top sealer station. The sprocket is attached to the second end of the shaft. The sprocket engages with the conveyor chain for simultaneous movement of the shaft with the conveyor chain. The sprocket is capable of rotating the shaft about the shaft axis and thereby rotating each of the plurality of rollers about their own axis. The sprocket may be attached to the rotating frame.

Each of the plurality of rollers may have a pseudo-elliptical shape. Alternatively, each of the plurality of rollers may have a cylindrical shape. The device may be positioned below the top sealer of the packaging machine. The movement of the shaft may be indexed to the movement of the conveyor. The plurality of rollers may consists of two rollers positioned symmetrically about the shaft. The carton may be a gable-top carton.

Another aspect of the present invention is a packaging machine for forming, filling and sealing each carton in a plurality of cartons traveling along a predetermined carton path. The packaging machine includes a conveyor, a top sealer and at least one carton concaving device. The conveyor moves each of the cartons along a predetermined carton path. The top sealer seals a fin of a gabled end of each of the plurality of cartons. The top sealer is positioned at a station downstream from the filling of the plurality of cartons with a product. The top sealer is located above the conveyor and above the predetermined carton path. The carton concaving device manipulates and maintains the shape of each the plurality of cartons prior to and during the sealing of the fin of each of the plurality of cartons at the top sealer. The carton concaving device is positioned to one side of the conveyor.

The packaging machine may further include a second carton concaving device positioned on the opposite side of the conveyor from the first carton concaving device. The second carton concaving device is symmetrical with the first carton concaving device. The packaging machine may still further include a plurality of predetermined carton paths parallel to one another. The packaging machine may still further include a plurality of top sealer devices for each of the predetermined cartons paths, positioned above each of the plurality of predetermined carton paths. The packaging machine may still further include a plurality of conveyors for conveying the plurality of cartons on each of the plurality of predetermined carton paths. The packaging machine may still further include a plurality of carton concaving devices. Each of the plurality of predetermined carton paths have a carton concaving device on each side thereof for symmetrical concaving of cartons being conveyed along each of the plurality of carton paths at each of the corresponding top sealer devices.

Another aspect of the present invention is a method for manipulating the shape of a carton being conveyed on a form, fill and seal packaging machine. The packaging machine has a top sealer to seal the top of the carton at a station downstream from a filling station. The first step is conveying a pre-formed carton along a pathway of the packaging machine. The next step is filling a carton with a flowable material at a fill station on the packaging machine. The next step is exerting a force on both sides of the pre-formed carton to concave the pre-formed carton to a predetermined shape. The final step is sealing the top fin of debulged carton at a top sealing station on the packaging machine. The step of exerting a force on both sides of the preformed carton is accomplished by a pair of carton concaving devices.

It is a primary object of the present invention to provide a device for debulging a carton prior to sealing of the carton.

It is an additional object of the present invention to provide a device for concaving the sidewall of a carton on a packaging machine.

It is an additional object of the present invention to provide a device which may be integrated on an existing packaging machine.

It is an additional object of the present invention to provide a device for concaving the sidewall of a carton which is indexed to the movement of a conveyor.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a preferred gable top carton.

Figure 2:
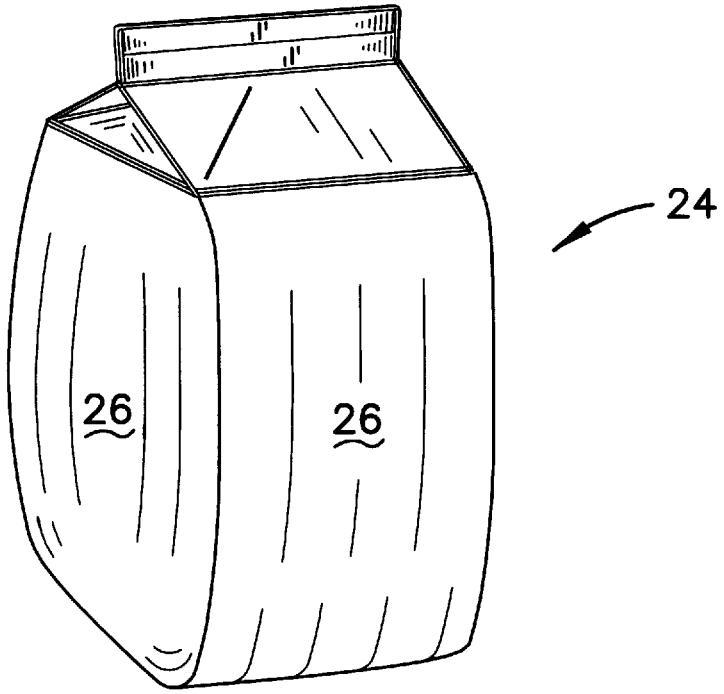

There is illustrated in FIG. 2 a perspective view of a bulged gable top carton.

Figure 3:
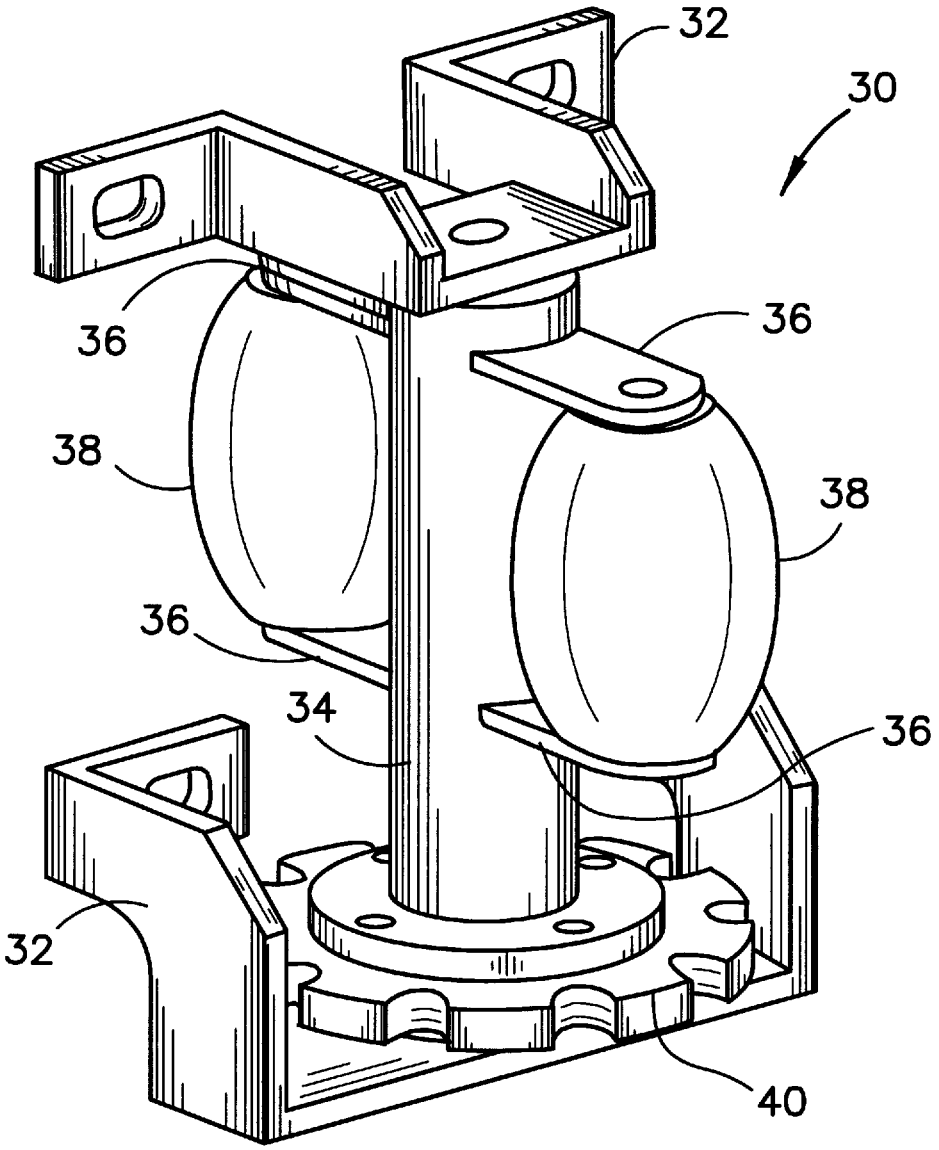

There is illustrated in FIG. 3 a top perspective view of the carton concaving device of the present invention.

Figure 4A:
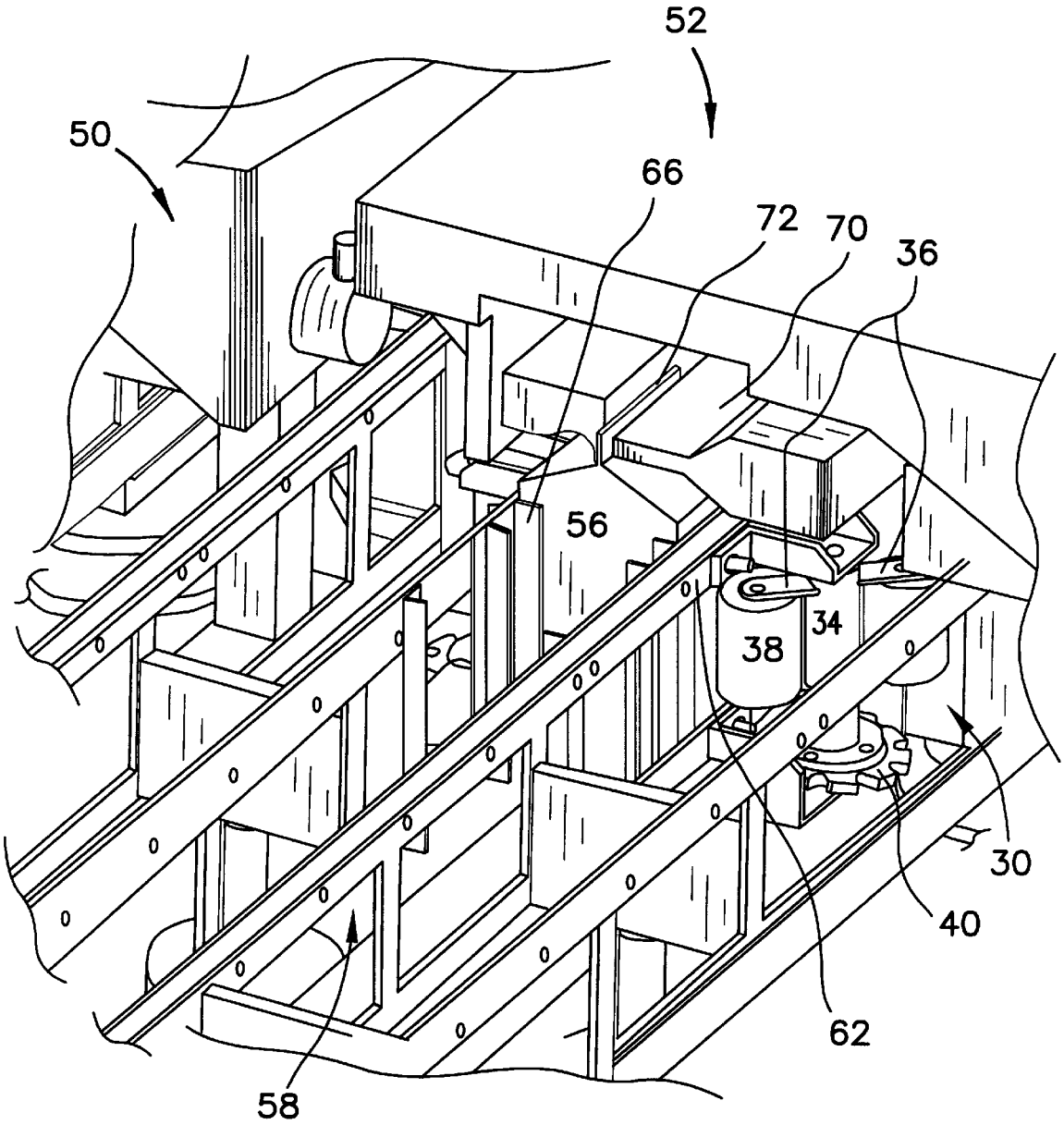

There is illustrated in FIG. 4A a perspective view of the carton concaving device of the present invention on a packaging machine at a first point of time.

Figure 4B:
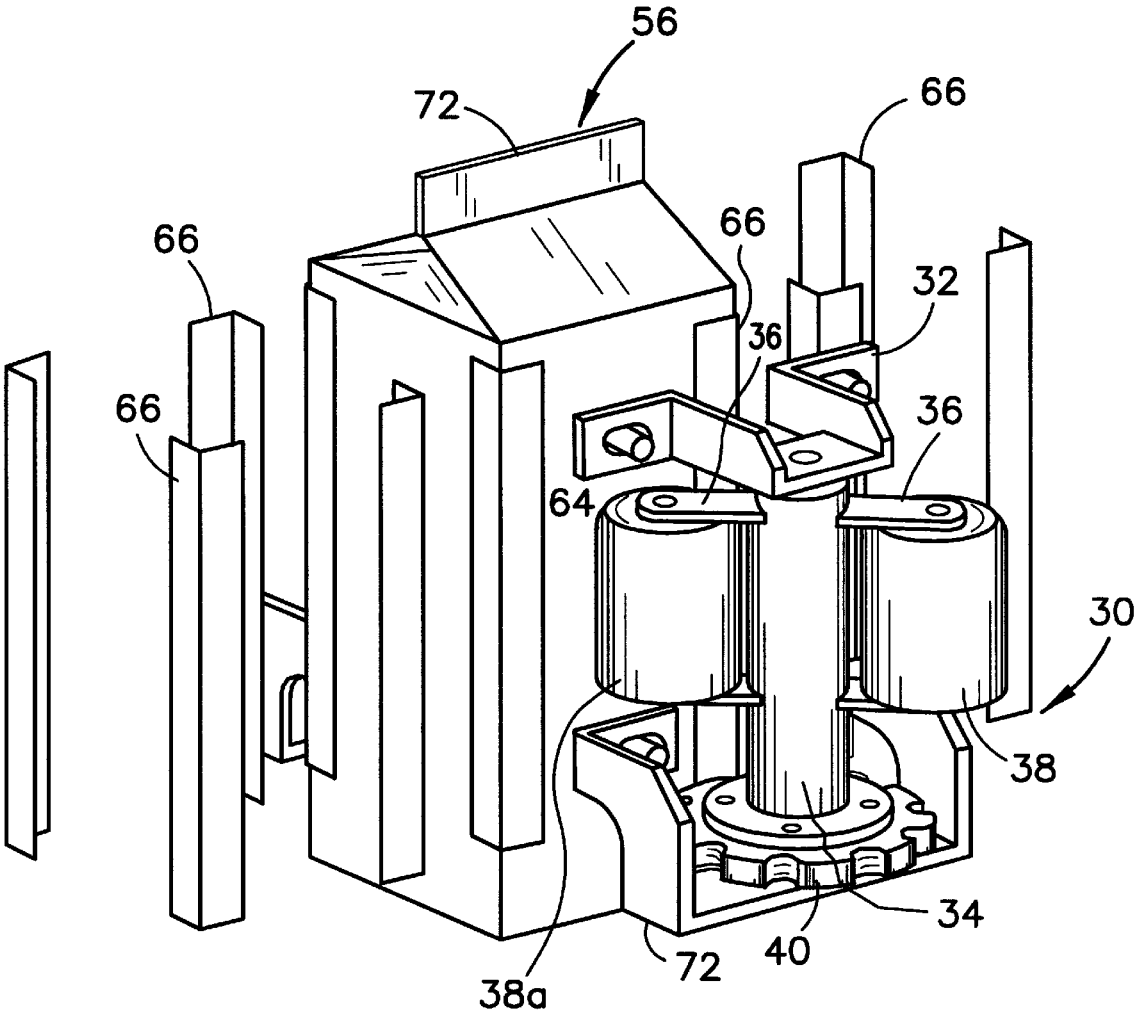

There is illustrated in FIG. 4B an isolated perspective view of the carton and carton concaving device of FIG. 4A.

Figure 4C:
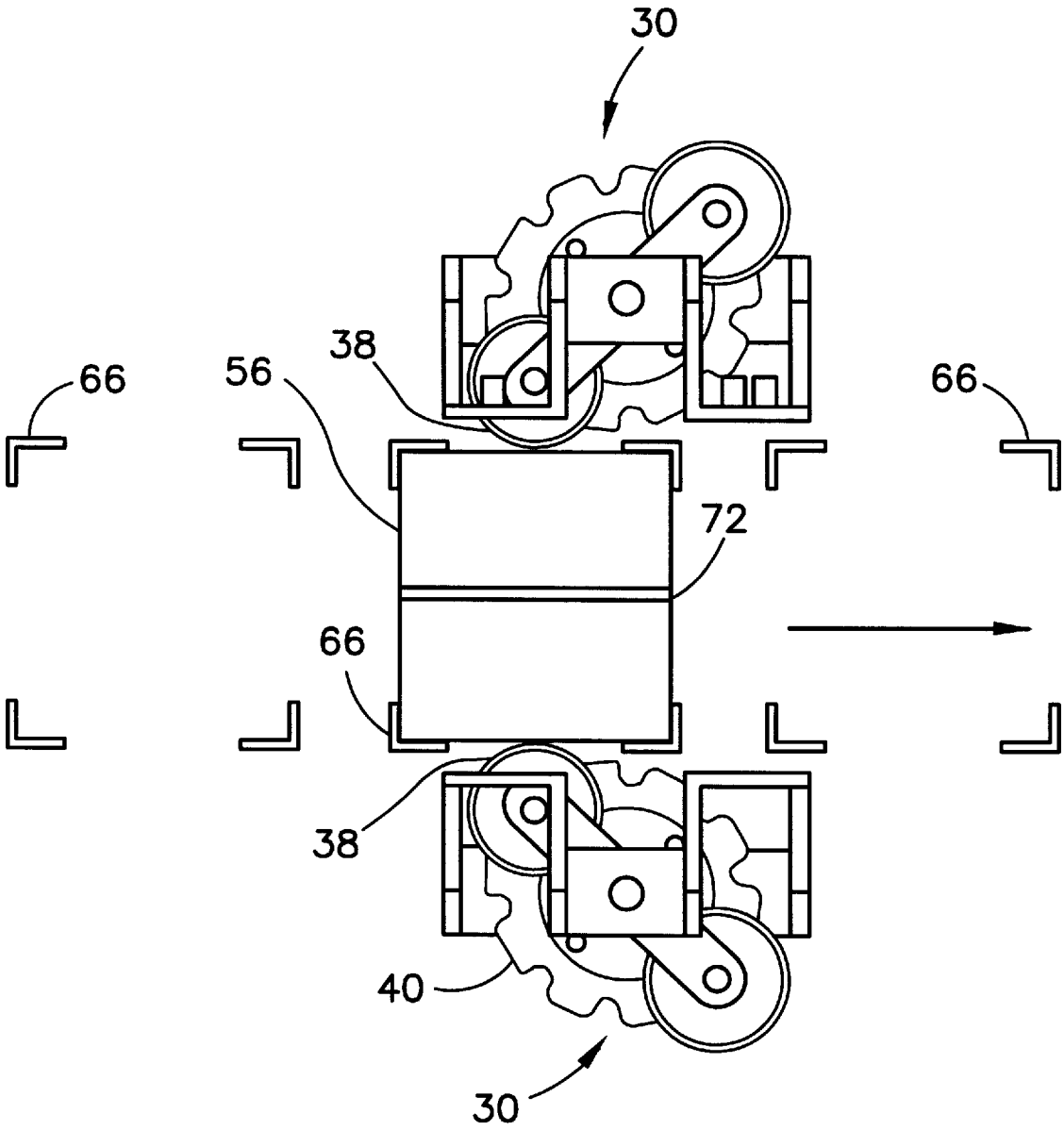

There is illustrated in FIG. 4C a top isolated view of the carton and carton concaving device of FIG. 4A.

Figure 5A:
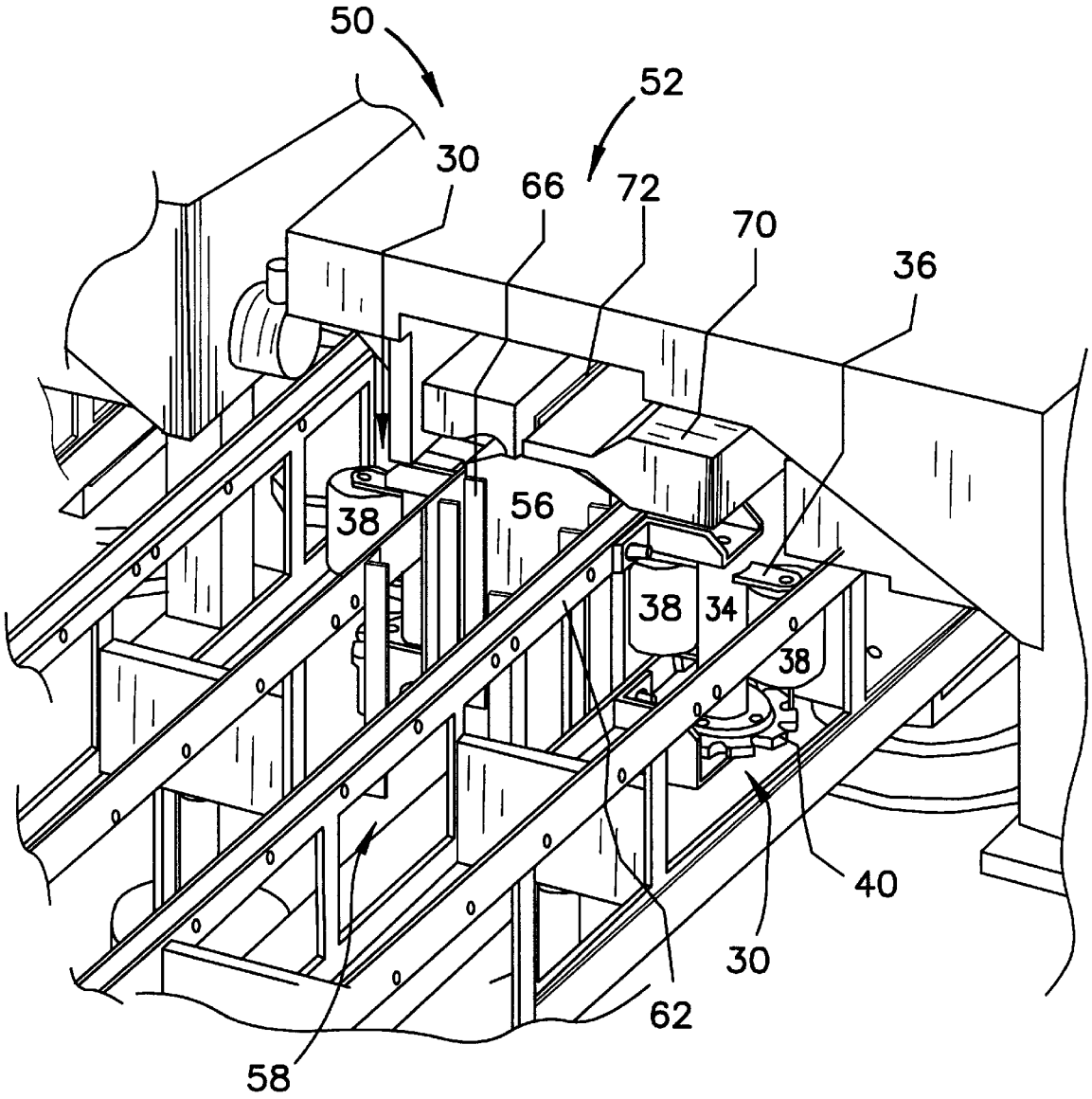

There is illustrated in FIG. 5A a perspective view of the carton concaving device of the present invention on a packaging machine at a second point of time.

Figure 5B:
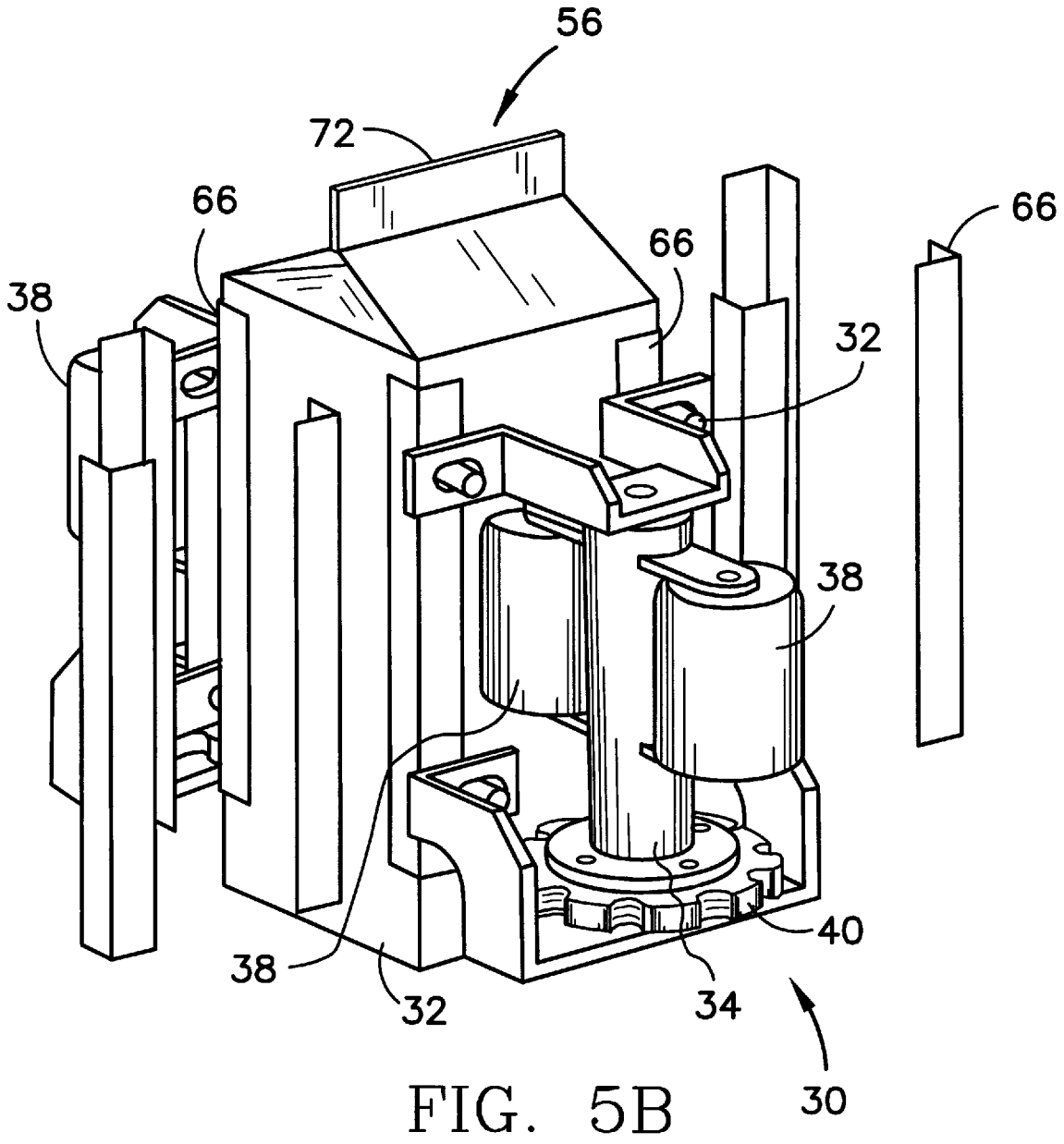

There is illustrated in FIG. 5B an isolated perspective view of the carton and carton concaving device of FIG. 5A.

Figure 5C:
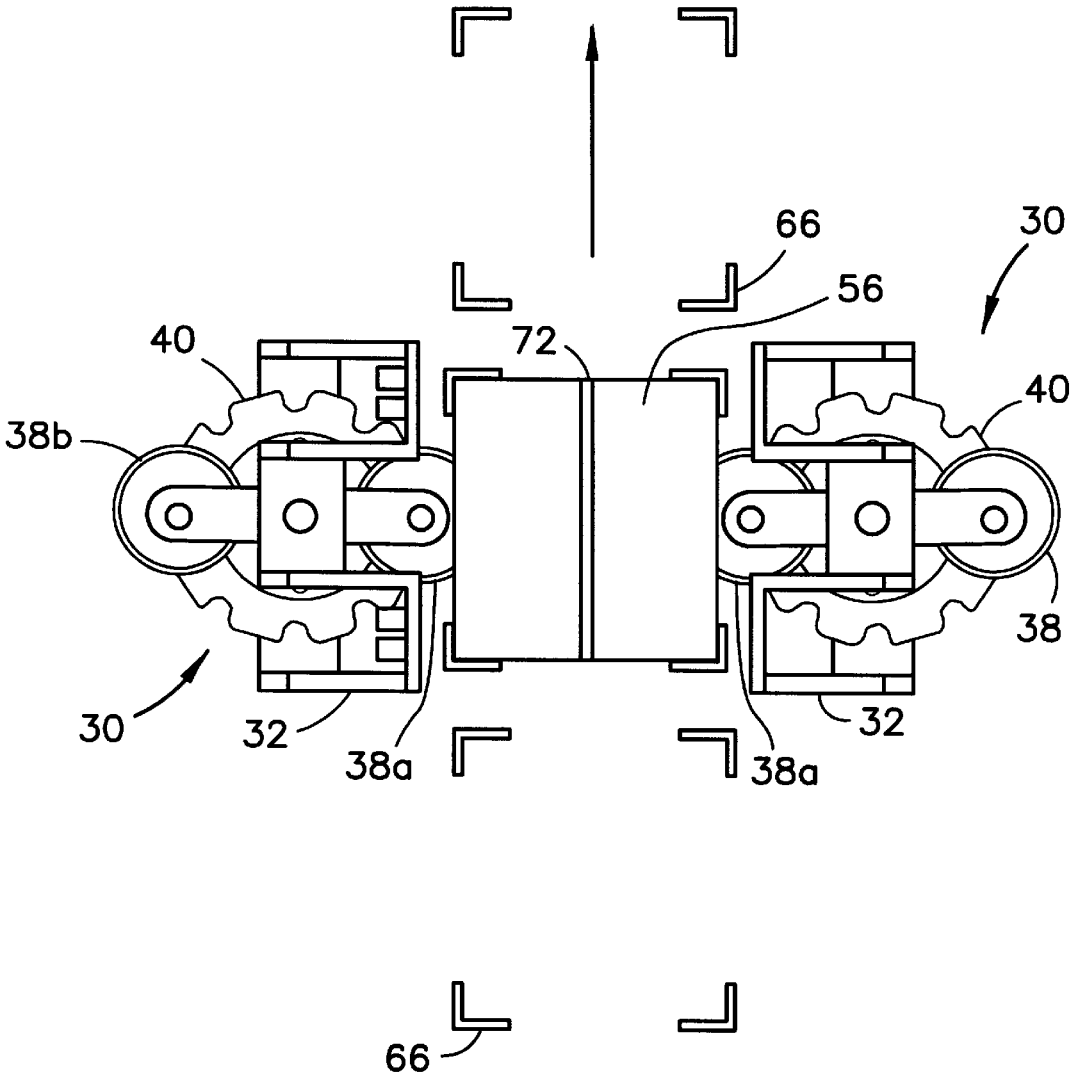

There is illustrated in FIG. 5C a top isolated view of the carton and carton concaving device of FIG. 5A.

Figure 6A:
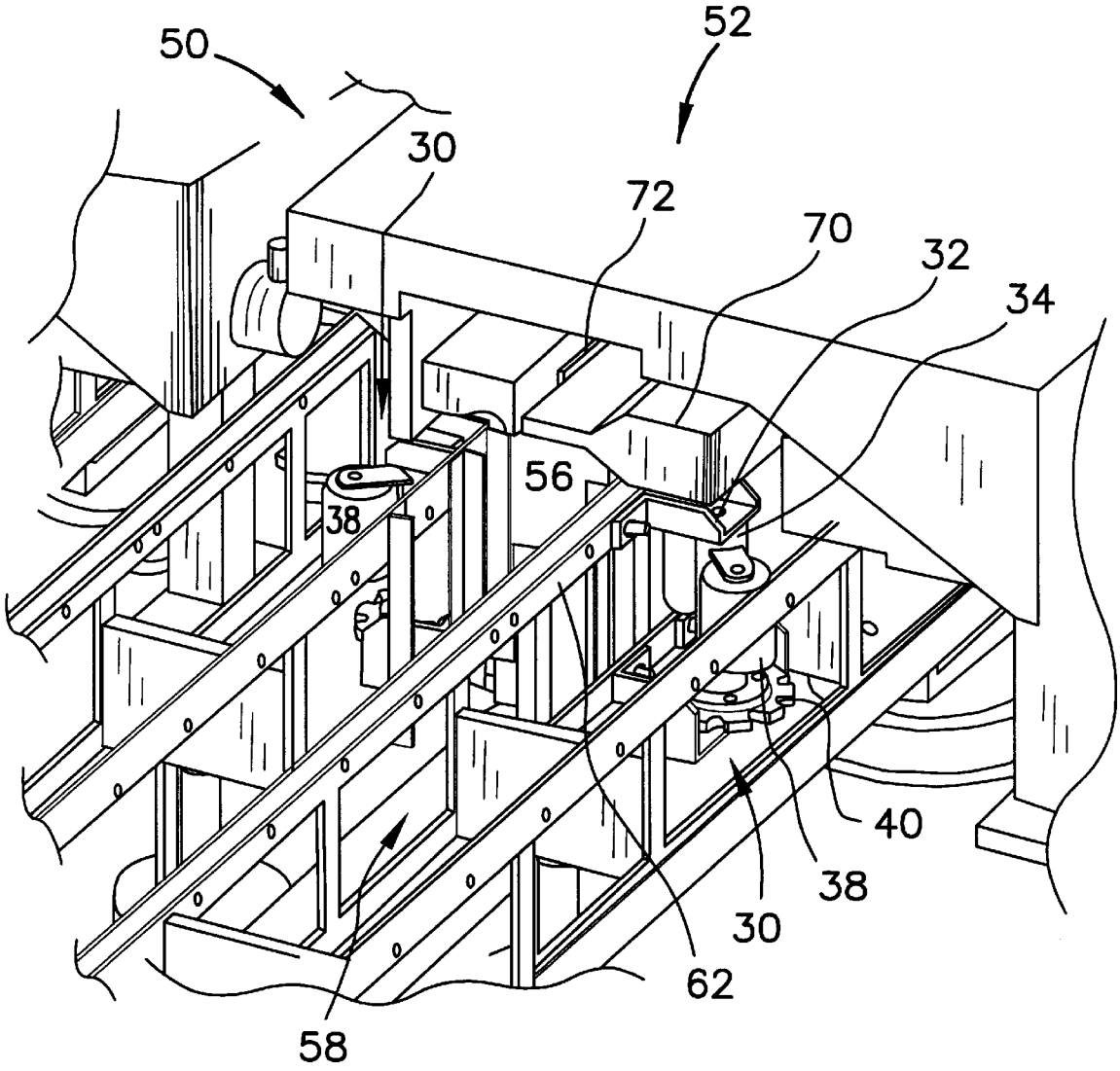

There is illustrated in FIG. 6A a perspective view of the carton concaving device of the present invention on a packaging machine at a third point of time.

Figure 6B:
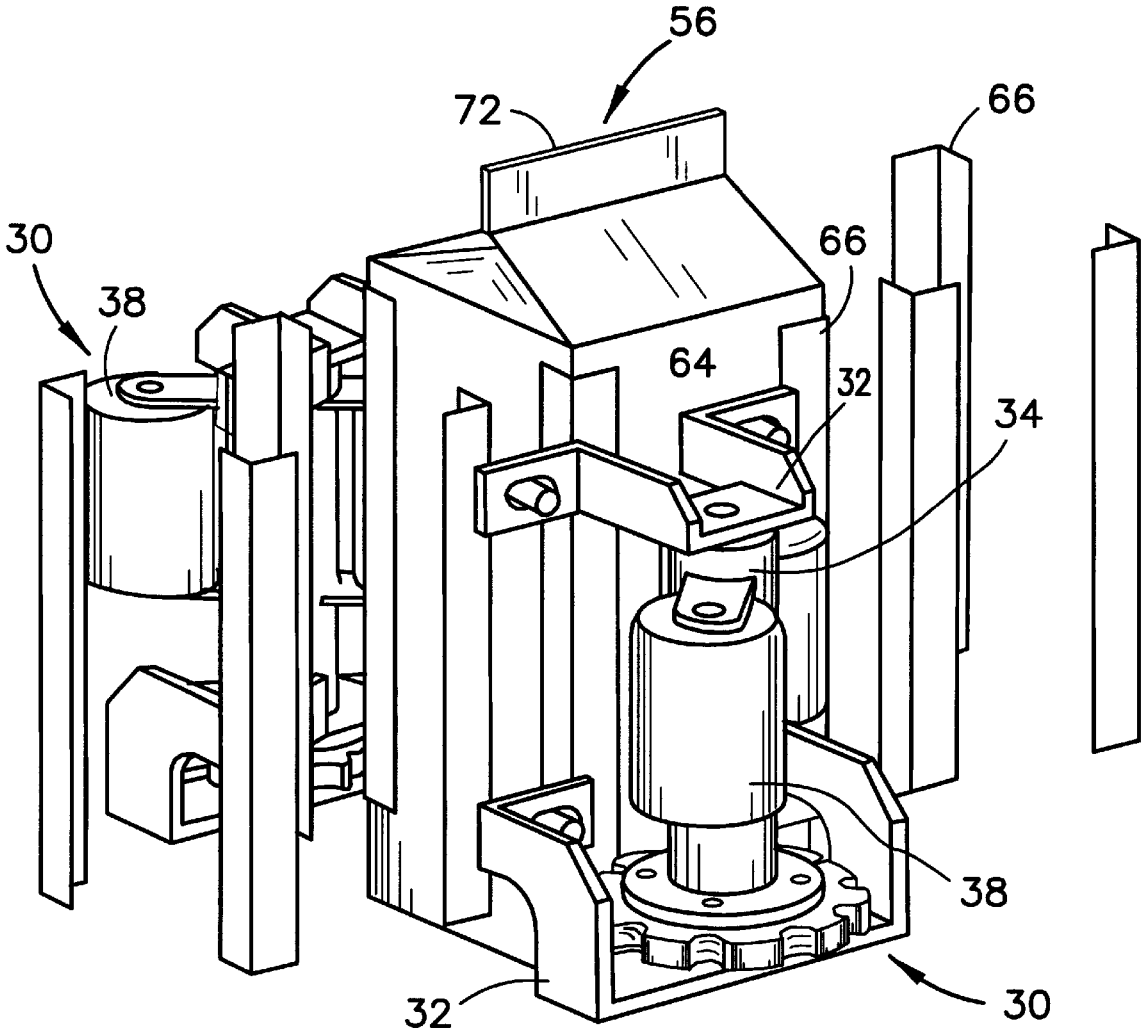

There is illustrated in FIG. 6B an isolated perspective view of the carton and carton concaving device of FIG. 6A.

Figure 6C:
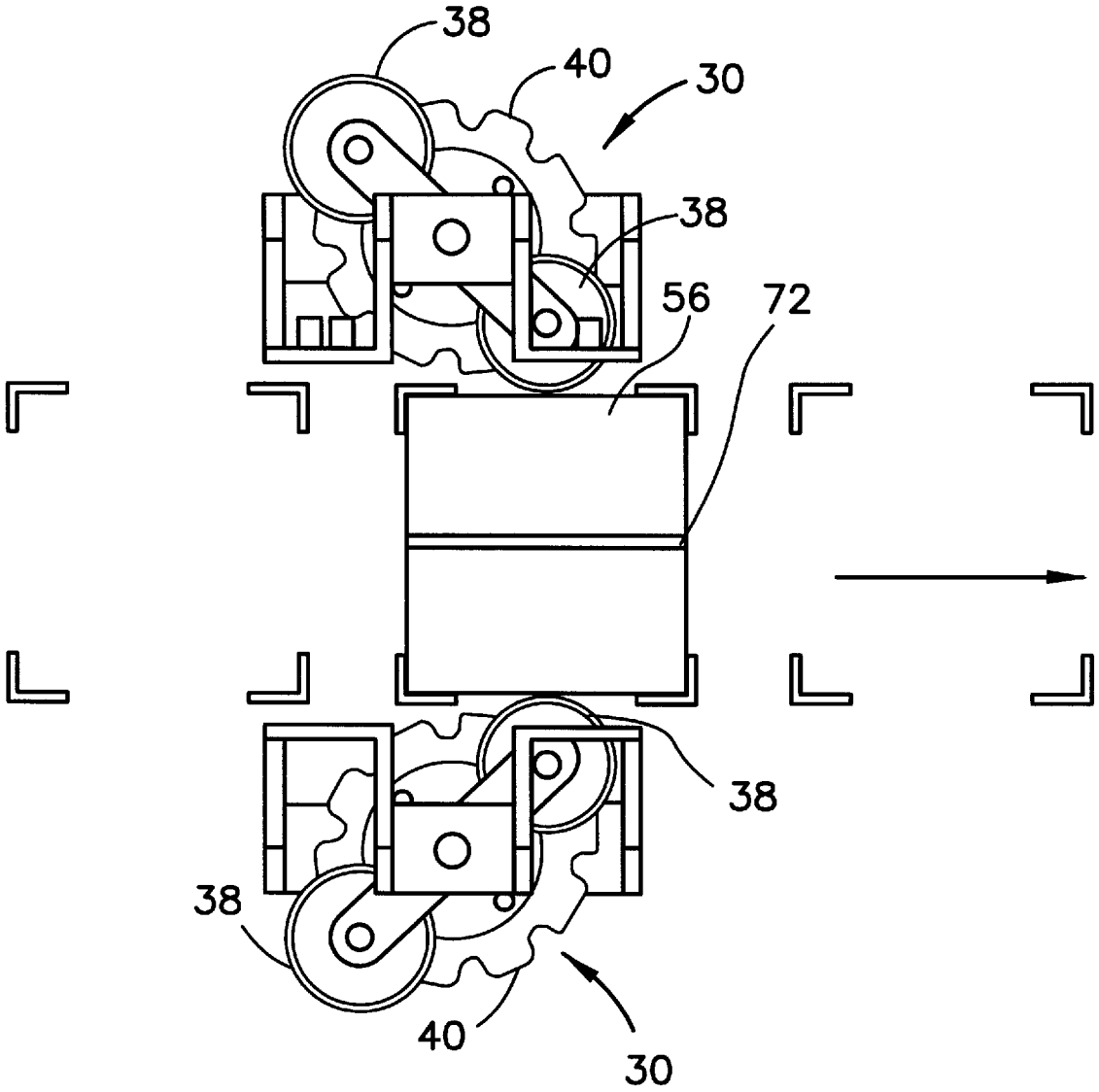

There is illustrated in FIG. 6C a top isolated view of the carton and carton concaving device of FIG. 6A.

Figure 7A:
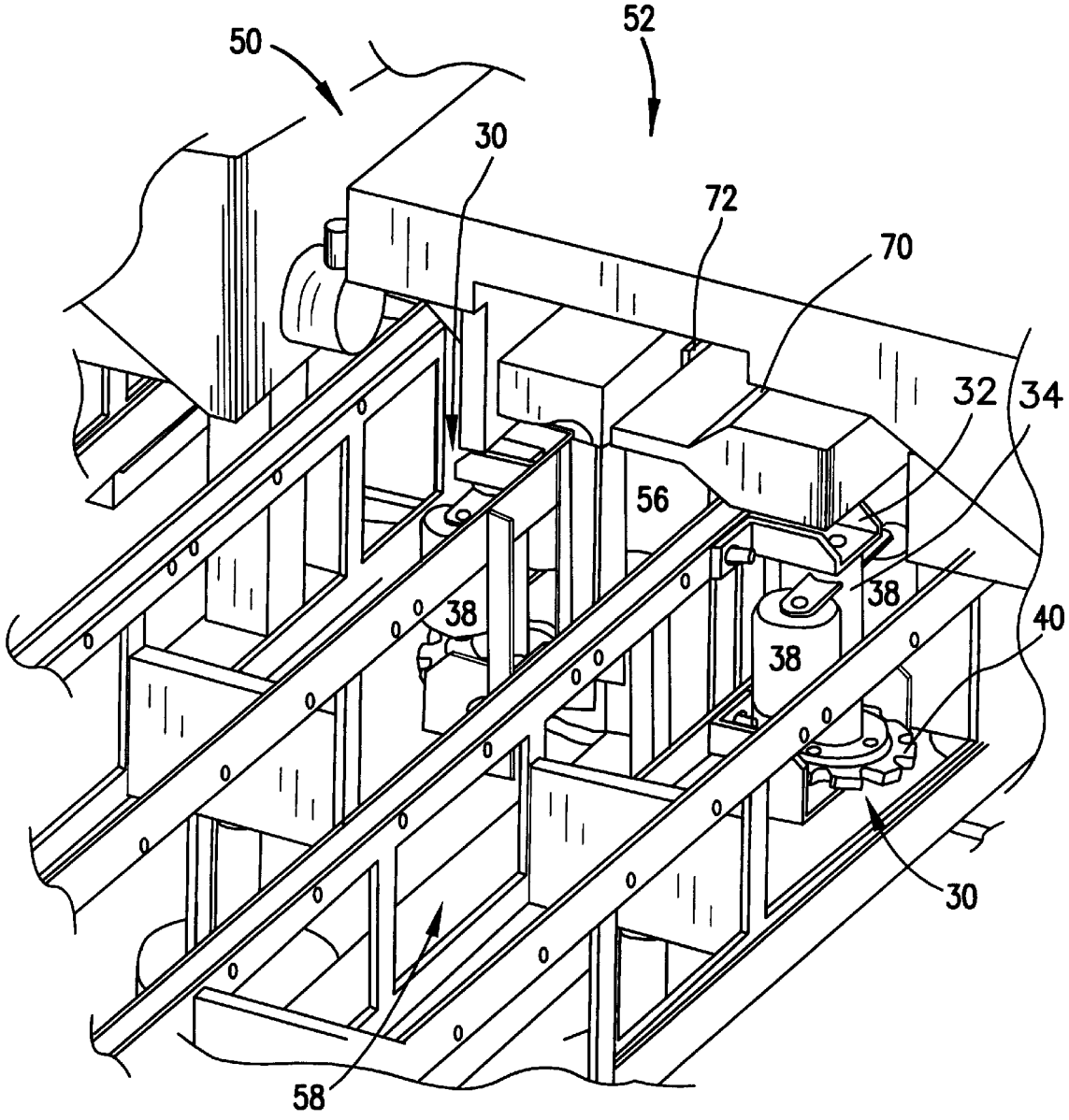

There is illustrated in FIG. 7A a perspective view of the carton concaving device of the present invention on a packaging machine at a first point of time.

Figure 7B:
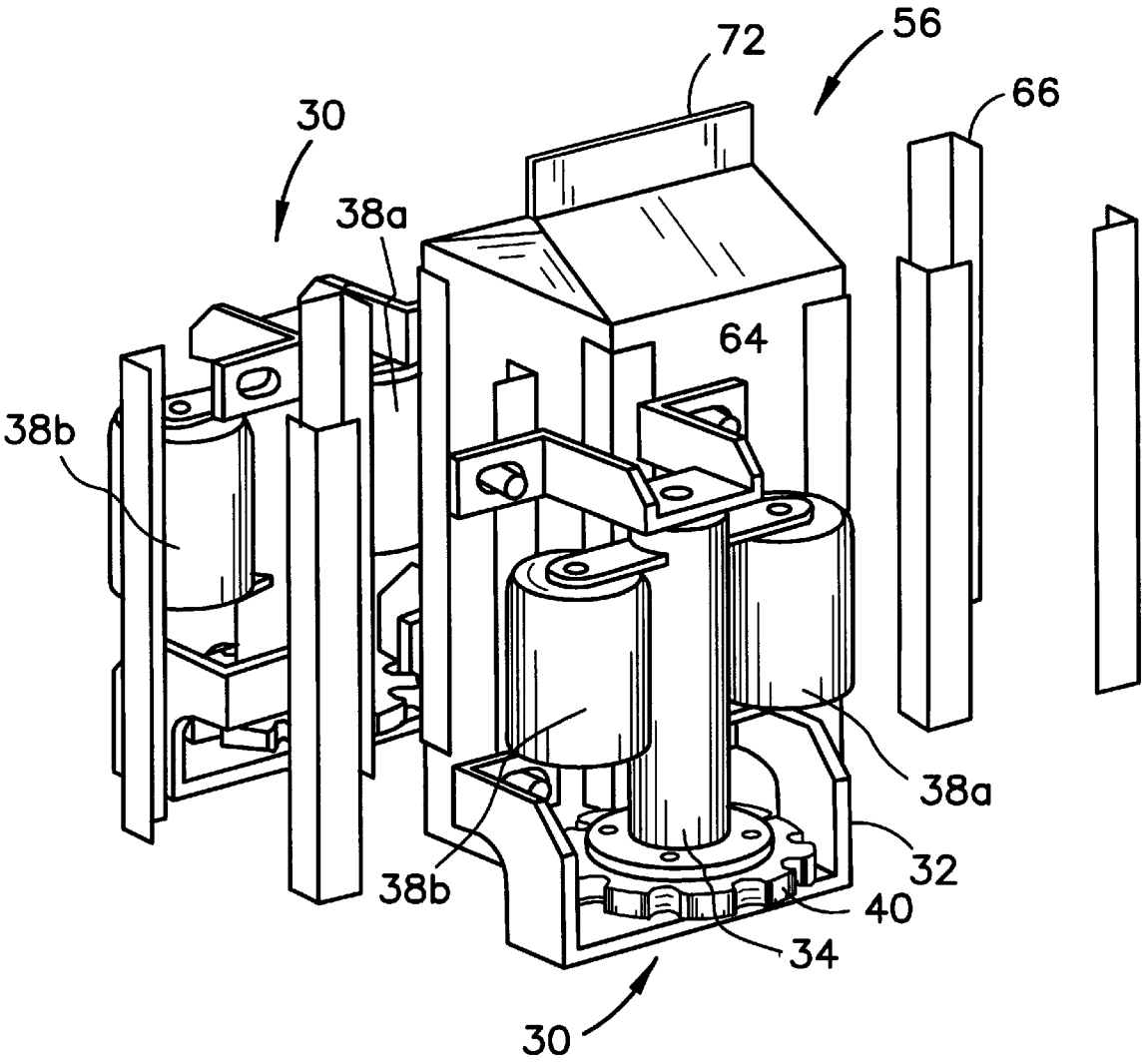

There is illustrated in FIG. 7B an isolated perspective view of the carton and carton concaving device of FIG. 7A.

Figure 7C:
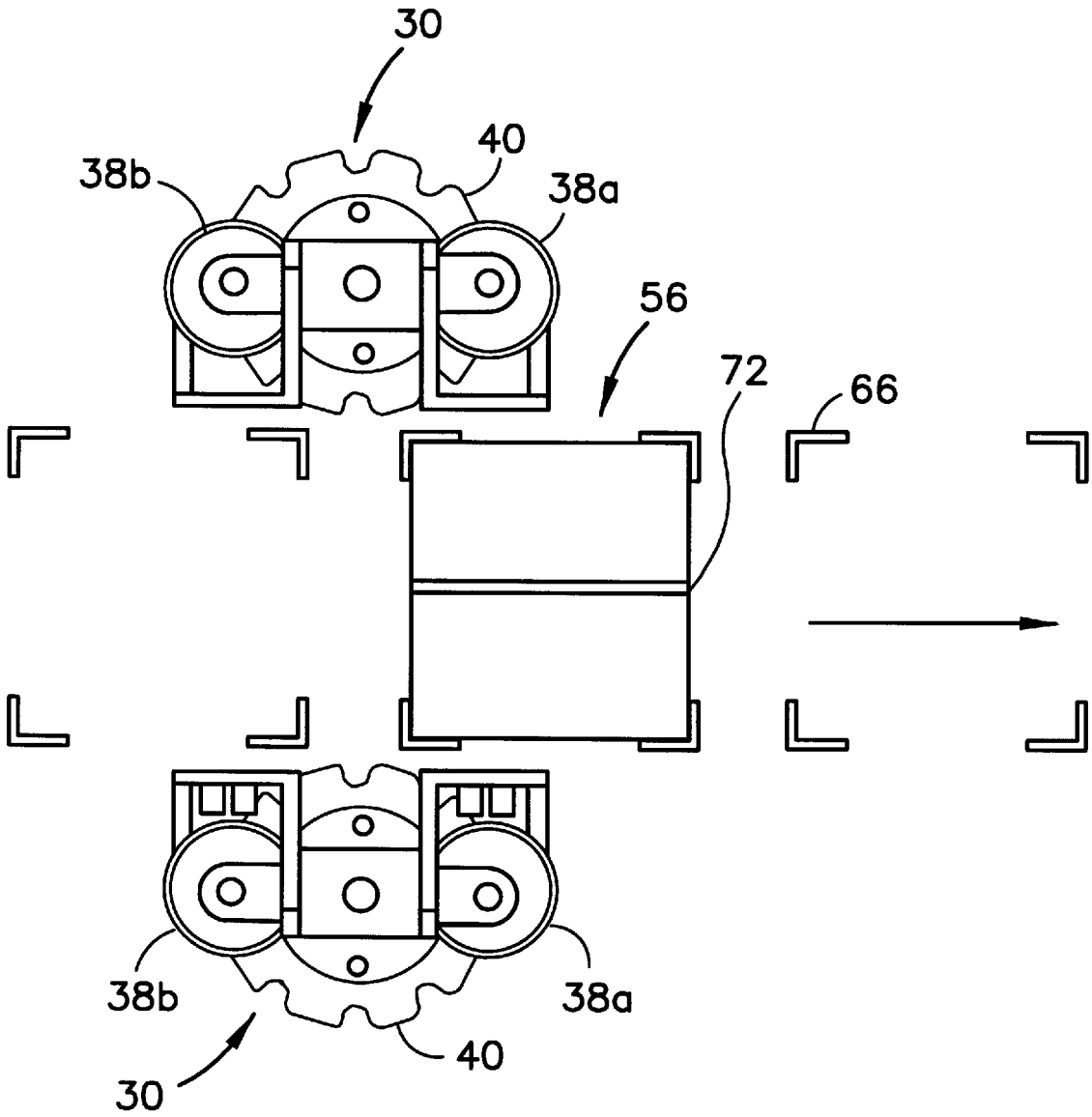

There is illustrated in FIG. 7C a top isolated view of the carton and carton concaving device of FIG. 7A.

DETAILED DESCRIPTION OF THE INVENTION

Figure 1:
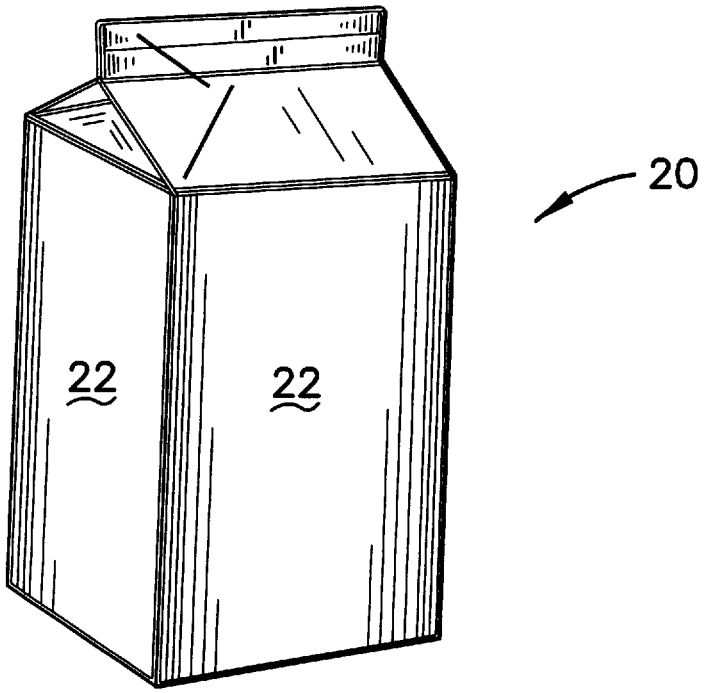

There is illustrated in FIG. 1 a perspective view of a preferred gable top carton. As shown in FIG. 1, the gable top carton 20 has sidewalls 22 which do not substantially bulge outside of the plane from the bottom of the carton to the top of the carton. This is a preferred carton, and desirable from a dairy perspective and consumer perspective. All cartons will bulge to some extent due to the flexibility of the carton material (usually paperboard with a polyethylene coating) and the weight of the product (usually juice or milk). However, product spoilage in a sealed carton produces gasses, increasing the internal pressure and thereby causing the carton to bulge even more. Also, cartons bulge due non-spoilage factors related to the packaging of the carton. The contents of these cartons are fine even though the carton is bulged. There is illustrated in FIG. 2 a perspective view of a bulged gable top carton. As shown in FIG. 2, the bulging carton 24 has sidewalls 26 which bulge outside of the plane from the bottom of the carton to the top of the carton. Now if the bulging carton 24 is bulging because of the packaging process and not for spoilage reasons, the carton 24 will still be rejected because it will be perceived by the dairy and consumers that the contents have spoiled.

There is illustrated in FIG. 3 a top perspective view of the carton concaving device of the present invention. The present invention will limit the amount of non-spoilage bulging thereby reducing the amount of cartons rejected because of bulging. The carton concaving device of the present invention is generally designated 30. The device 30 includes a frame attachment means 32, a shaft 34, a plurality of extending arms 36, a plurality of rollers 38 and a sprocket 40. The frame attachment means 32 may be metal hinge plates which are connected to each end of the shaft 34. The shaft is rotatable when connect to the frame attachment means 32. Although the shaft is shown as having a vertical axis, those skilled in the art will recognize that the shaft may have a horizontal axis. The frame attachment means 32 connects the device 30 to the frame of a packaging machine, not shown. In order to synchronize the movement of the device, the rotational axes of the shaft 34 and the rollers should be parallel with the sprocket axes of the conveyor chain.

The shaft 34 is rotated and is connected to the sprocket 40 at one end. The sprocket engages a conveyor chain, not shown, thereby causing the shaft 34 to rotate when the chain moves. In this manner, the device 30 is indexed to the movement of the conveyor. Extending transversely from the shaft 34 is the plurality of extending arms 36. Each of the extending arms 36 has a symmetrical counterpart on the opposite side of the shaft 34. Each of the extending arms 36 also has a parallel counterpart arm in the same vertical plane. Each of the plurality of rollers 38 is connected between these parallel extending arms 36. Each of the plurality of rollers 38 are rotatable about the vertical axis extending between the parallel extending arms 36. Each of the plurality of rollers 38 may have various shapes. A preferred shape is cylindrical, however, pseudo-elliptical as shown in FIG. 3 is also within the scope of the present invention. Still another shapes may be utilized in practicing the present invention without departing from the scope of the present invention. The rollers 38 main function is to deflect the sidewalls of cartons being processed on packaging machine in order to prevent bulging of the cartons and thereby reduce the number of perceived damaged cartons. The device 30 may be an add-on part to an existing machine, or may be an integrated component of a new machine.

FIGS. 4A–7C demonstrate the operation of the device 30 during four phases (points of time) of one machine cycle. FIGS. 4A–4C illustrate a carton moving into a sealing position to be sealed by a top sealer at a station on a form, fill and seal packaging machine. The sealing station is downstream from a fill station where the carton was previously filled with a contents (usually juice or milk). A preferred top sealer is disclosed in copending U.S. patent application Ser. No. 08/828,311 filed on Mar. 28, 1997, entitled Top Folding And Sealing Apparatus For Forming And Sealing The Fin Of A Gabled Carton, which is hereby incorporated by reference. There is illustrated in FIG. 4A a perspective view of the carton concaving device of the present invention on a packaging machine at a first point of time. As shown in FIG. 4A, the device 30 is integrated on a packaging machine 50. The device 30 is located at a top sealing station 52 of the packaging machine 50. The top sealing station 52 is the station downstream from the filling station 54, not shown, where the product is filled into the carton 56. The stations 54 and 56, lie on a predetermined carton path 58. A conveyor 60 follows the predetermined carton path 58 thereby moving cartons 56 from one station to another. The device 30 is positioned to one side of the carton path 58 on a frame 62 of the packaging machine 50.

There is illustrated in FIG. 4B an isolated perspective view of the carton and carton concaving device of FIG. 4A. As shown in FIG. 4B, roller 38A is just about to engage the sidewall 64 of the carton 56. The carton 56 is held in place by a plurality of conveyor guides 66. As the carton 56 is conveyed by conveyor 60, the conveyor chain 68, not shown, rotates the sprocket 40, thereby rotating shaft 34 which in turn rotates roller 38A. Roller 38A engages the sidewall 64 by rotating itself about its own vertical axis. The self-rotation of roller 38A allows for a smooth deflection of the sidewall 64.

There is illustrated in FIG. 4C a top isolated view of the carton and carton concaving device of FIG. 4A. As shown in FIG. 4C, a preferred use of the carton concaving device of the present invention is to utilize two devices 30 on both sides of a carton 56. Referring again to FIG. 4C, the rollers 38 maintain the sidewalls 64 of the carton 56 within a vertical plane extending from the bottom of the carton to the top of the carton.

FIGS. 5A–C illustrate the device in operation at a second phase (second point of time). At this phase, the carton has stopped and is in the sealing position below the top sealer. The rollers 38 have also stopped and are fully deflected. This is the most important position for the carton in terms of bulging. If the carton is bulging at this phase, the top sealer will seal a bulged carton which is ruined and must be discarded. There is illustrated in FIG. 5A a perspective view of the carton concaving device of the present invention on a packaging machine at a second point of time. As shown in FIG. 5A, the rollers 38 are perpendicular with the sidewalls 64 of the carton 56. The top sealer 70 is also sealing the top fin 72 of the carton 56. The illustrated top sealer 70 is an ultrasonic sealer consisting of an anvil and a horn. There is illustrated in FIG. 5B an isolated perspective view of the carton and carton concaving device of FIG. 5A. There is illustrated in FIG. 5C a top isolated view of the carton and carton concaving device of FIG. 5A. As shown in FIG. 5C, the rollers 38 are actually concaving the sidewalls 64 of the carton 56. This exerted force ensures that the carton will not bulge after being sealed at the top sealer station 52.

FIGS. 6A–6C illustrated the device 30 in operation at a third phase (third point in time) of the machine cycle. At this phase, the carton 56 is moving out of the sealing position. The roller is about to break contact with the side of the carton. There is illustrated in FIG. 6A a perspective view of the carton concaving device of the present invention on a packaging machine at a third point of time. As shown in FIG. 6A, the rollers are at approximately a 45 degree angle to the predetermined carton path 58. The carton 56 is being conveyed forward to the next station on the packaging machine 50 by the conveyor which in turn rotates the shaft 34 in a set index cycle. There is illustrated in FIG. 6B an isolated perspective view of the carton and carton concaving device of FIG. 6A. There is illustrated in FIG. 6C a top isolated view of the carton and carton concaving device of FIG. 6A. As shown in FIG. 6C, the rollers 38 are at 45 degree angles to the sidewalls 64 of the carton 56.

FIGS. 7A–7C illustrate the device 30 at a fourth phase (fourth point of time) of the machine cycle. At this phase, the carton has moved away from the top sealer 70. The rollers 38 are also at a mid-point of the conveyor chain index. There is illustrated in FIG. 7A a perspective view of the carton concaving device of the present invention on a packaging machine at a first point of time. As shown FIG. 7A, the carton 56 has almost departed the top sealing station 52. As this carton 56 departs, a subsequent carton will be conveyed into place under the top sealer 70.

There is illustrated in FIG. 7B an isolated perspective view of the carton and carton concaving device of FIG. 7A. There is illustrated in FIG. 7C a top isolated view of the carton and carton concaving device of FIG. 7A. As shown in FIG. 7C, the rollers 38 are now parallel with the predetermined carton path 58. One machine cycle has been completed and another is ready to begin. As soon as a subsequent carton 56 is conveyed, the shaft will rotate accordingly to place a roller 38 against the sidewall 64 of the carton 56 as in the first phase.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A packaging machine for forming, filling and sealing a series of gable top cartons traveling along a predetermined carton path, each carton having a first pair of opposing flaps disposed transverse to the predetermined carton path and a second pair of opposing top flaps disposed longitudinal to the predetermined carton path, the first and second pair of opposing flaps adapted to form a gabled structure of each of the series of gable top cartons, one of the second plurality of opposing top flaps having a spout projecting therefrom, the packaging machine comprising:

a conveyor for moving each of the cartons along a predetermined carton path;

a top folding device comprising a first pre-folder for directing the first pair of opposing top flaps of each carton toward each other, thereby also causing the second pair of opposing top flaps to be urged toward each other, a second pre-folder disposed downstream of the first pre-folder along the predetermined carton path for directing the second pair of opposing top flaps of each carton together as each carton travels along the predetermined carton path, and first and second crimping wheels disposed downstream of the second pre-folder for bending the second pair of opposing top flaps to form a closed fin structure as each carton proceeds therebetween along the predetermined carton path, each of the crimping wheels having a flat surface and a beveled surface, at least one of the crimping wheels having an annular recessed portion into the flat surface to pass the spout projecting from one of the second plurality of opposing top flaps;

a top sealer device for sealing the closed fin structure of each gable top carton, the top sealer device positioned at a station downstream from the top folding device, the top sealer device located above the conveyor and above the predetermined carton path; and two carton concaving devices for manipulating and maintaining the shape of each the plurality of cartons prior to and during the sealing of the closed fin structure of each of the plurality of cartons at the top sealer device, the two carton concaving devices positioned on each side of the conveyor below the top sealing device to engage each carton immediately subsequent to the formation of the closed fin structure by the crimping wheels.

2. The packaging machine according to claim 1 wherein each of the carton concaving devices comprises:

frame attachment means for connecting the device to the packaging machine at the top sealer station;

a shaft capable of rotating about a shaft axis, the shaft having a first end and a second end, the shaft having a plurality of arms extending transversely therefrom, the shaft connected to the frame attachment means on at least one of the first end and the second end, a plurality of rollers attached to the corresponding plurality of extending arms, each of the plurality of rollers rotating about a roller axis, each of the roller axes parallel to the shaft axis, each of the rollers capable of deflecting a side of the carton at the top sealer station; and a sprocket attached to the second end of the shaft, the sprocket engaged with the conveyor for simultaneous movement, the sprocket capable of rotating the shaft about the shaft axis and thereby rotating each the plurality of rollers.

3. The packaging machine according to claim 2 wherein the movement of the shaft is indexed to the movement of the conveyor.

* * * * *